United States Patent [19]

Vandermer

[11] 4,454,624

[45] Jun. 19, 1984

[54] SCOURING PAD HOLDER

[76] Inventor: Barbara B. Vandermer, 12128 Carroll Mill Rd., Ellicott City, Md. 21043

[21] Appl. No.: 411,661

[22] Filed: Aug. 26, 1982

[51] Int. Cl.[3] ..... A47L 13/07

[52] U.S. Cl. ..... 15/209 D; 15/227

[58] Field of Search ..... 15/227, 244 R, 209 D

[56] References Cited

U.S. PATENT DOCUMENTS

| | | | |
|---|---|---|---|
| 1,954,742 | 4/1934 | McSwain | 51/186 |
| 1,955,989 | 4/1934 | Uhri | 2/20 |
| 1,990,553 | 2/1935 | Koffler et al. | 15/227 X |
| 2,069,449 | 2/1937 | Jensen | 15/227 X |
| 2,109,404 | 2/1938 | Trevellyan | 15/209 D X |
| 2,441,268 | 5/1948 | Haber | 15/209 D |
| 2,479,131 | 8/1949 | Pari | 15/209 D |
| 2,529,434 | 11/1950 | Walker | 15/209 D |
| 2,624,161 | 1/1953 | Snell | 51/187 |
| 2,753,581 | 7/1956 | Clark | 15/209 |
| 2,792,583 | 5/1957 | Alfano | 15/209 D |
| 2,996,850 | 8/1961 | Hoffman | 51/183 |
| 3,151,346 | 10/1964 | Gray | 15/227 X |
| 3,163,875 | 1/1965 | Campana | 15/227 X |
| 3,643,386 | 2/1972 | Grzyll | 51/391 |

*Primary Examiner*—Chris K. Moore

*Attorney, Agent, or Firm*—John F. McClellan, Sr.

[57] ABSTRACT

A unitary plastic holder for steel wool or other abrasive scouring pads has a first jaw with a rounded front end with a conforming first rigid hood on top which is open at the rear, for protecting a user's fingers from embedment of fragments, impacts, and other injury; similarly at a trailing location a rounded front end on a second jaw has beneath it a conforming second rigid hood for protecting a user's thumb; resiliently connecting and aligning the jaws and biasing them in-plane is a first straight arm portion leading back on one side from the first hood and then returning forwardly and centrally to the second hood, and filling the space between the first straight arm portion and a second straight arm portion; a steel wool pad is resiliently grasped between the double width portion and the straight arm portions; a cusp-shaped opening at the rear may be used for further securance of the steel wool pad.

1 Claim, 3 Drawing Figures

SCOURING PAD HOLDER

FIELD OF THE INVENTION

This invention relates generally to tools and particularly to a manual holder for abrasive pads.

BACKGROUND OF THE INVENTION

Manually held scouring pads such as steel wool soap pads are widely used in domestic and industrial cleaning and burnishing. However, they tend to imbed in or otherwise injure the fingers and thumbs holding them and generally abrade and roughen the skin. In addition, the reciprocating scouring motion often causes the fingers and thumb to strike parts of the object scoured, further causing irritation and injury.

PRIOR ART

In the prior art various U.S. patents have disclosed holders for (and with) abrasives:

U.S. Pat. No. 1,954,742 granted to C. E. McSquain et al on 4-10-34 disclosed a two-jaw tool with abrasive but no shield;

U.S. Pat. No. 1,955,969 granted to K. M. Uhrilon on 4-24-34, disclosed a finger housing and a thumb housing connected by a flexible loop (see especially FIG. 6) for holding abrasive pads;

U.S. Pat. No. 2,624,161 granted to H. D. Snell on 1-6-53, disclosed a two-jaw abrading tool;

U.S. Pat. No. 2,645,064 granted to J. Pavlovis on 7-14-53 disclosed (FIG. 3) a two-jawed clamping member for abrasives;

U.S. Pat. No. 2,753,581 granted to G. C. Clark on 7-10-56 disclosed a scouring pad holder with central aperture for scouring pads and a pocket on each side for thumb and fingers to be inserted for gripping the scouring pad;

U.S. Pat. No. 2,996,850 granted to H. E. Hoffman on 8-22-61, disclosed a scouring pad holder with pocket;

U.S. Pat. No. 3,643,386 granted to J. V. Grzyll on 2-22-72, disclosed a glove with scouring-pad type material affixed to it.

SUMMARY OF THE INVENTION

However, none of the prior devices known has, at the same time, provided finger and thumb rigidly shielding means for holding a steel wool or other such abrasive pad, and flexibly aligned the shielding means and, through resilient bias, aided in gripping the abrasive pad while preferentially exposing a lower portion thereof for scouring; to provide such is a principal object of this invention.

Further objects are to provide a means as described that has a comfortable rounded-rear-end that can be pushed with the palm of the hand for heavy work, and that has a rounded front end for non-scarring, non-snagging operation in use.

Yet further objects are to provide a means as described which preferentially exposes scouring pads, which can hold abrasive pads of various sizes, which tends to prevent abrasive pads from slipping and grips them with a pinch grip of substantial mechanical advantage, which is non-corrosive, light weight, durable, can be made in any desired color, and which is economical to manufacture, ship and purchase.

Still further objects are to provide a means as described which is easy to clean, compact, easy to use, and attractive in appearance, provides more leverage, and gets into corners.

In brief summary given as cursory description only and not as limitation the invention may include the following: A unitary plastic holder for steel wool or other abrasive scouring pads has a first jaw with a rounded front end with a conforming first rigid hood on top which is open at the rear, for protecting a user's fingers from imbedment of fragments, impacts and other injury; similarly at a trailing location a rounded front end on a second jaw has beneath it a conforming second rigid hood for protecting a user's thumb; resiliently connecting and aligning the jaws and biasing them in-plane is a first straight arm portion leading back on one side from the first hood and then returning forwardly and centrally to the second hood, and filling the space between the first straight arm portion and a second straight arm portion; a steel wool pad is resiliently grasped between the double width portion and the straight arm portions; a cusp-shaped opening at the rear may be used for further securance of the steel wool pad.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
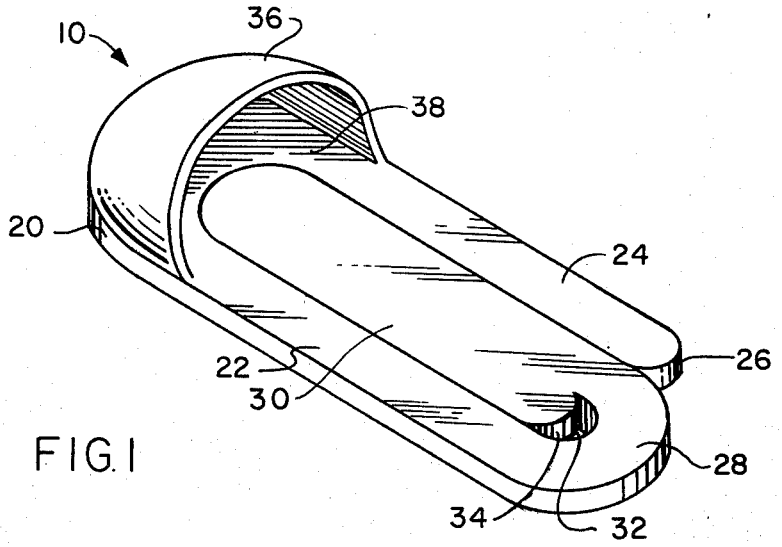
FIG. 1 is a top perspective view of the invention.

FIG. 1 shows the invention 10 in relaxed or non-use mode. The invention is a unitary piece preferably, and may be of resilient plastic such as polystyrene. In preferred embodiment, in plan view the outline is generally that of an inverted "U" with the front rounded part 20 of the "U" substantially wider than the width of the first and second arms 22, 24 of the "U".

The second arm 24 of the "U" terminates at the rear in a rounded end 26.

The first arm 22 of the "U" is slightly longer than the second arm 24 of the "U" and at the rear rounds in a 180° turn 28 to a double width portion 30 filling the space between the first and second arms of the "U", except for an opening 32. The opening 32 is generally cusp-shaped with the inner curvature of the 180° turn 28 forming one wall and the beginning of the double width portion 30 having a complementary shape forming the other wall. The close fit of these three parallel runs 22, 30 and 24 supportively guides them on each other.

The above portions are of generally planar configuration when in the relaxed mode.

A first rigid arcuate hood 36 protrusive on the top side, congruent with the rounded front end 20 and having an open rear 38 forms a protective shield for the fingers of the user. The degree of rigidity is such as to be form-maintaining in the aperture-free hood configuration shown, and preferably unyielding under normal loads.

Figure 2:
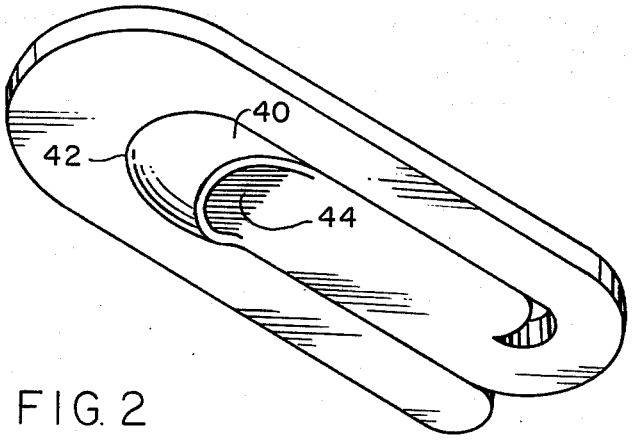
FIG. 2 is a bottom perspective view.

FIG. 2 shows that in bottom perspective the central configuration is similar except that there is a second rigid arcuate hood 40 congruent with the rounded front end 42 of the double width portion from which it protrudes, and that it has an open rear 44 forming a protective shield for the thumb of the user.

The protective shields in each case preferably are deep enough to cover the terminal joint of the digit an nominal size human hand, as indicated in the next figure.

Figure 3:
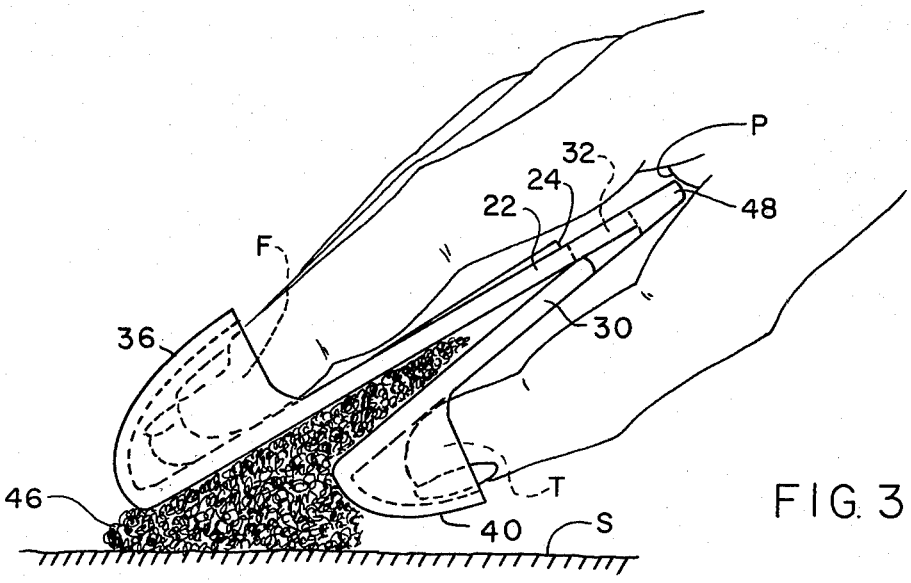
FIG. 3 is a side elevational view of the invention holding an abrasive pad.

FIG. 3 shows in side elevational view a typical scouring pad 46, which may be steel wool, clasped on one side between a jaw comprised by first and second arms 22, 24 springing against the second jaw comprised by double width inner portion 30, and protruding at the front in position for scouring a rough, greasy, encrused and/or corroded surface S. Further grip on the scouring pad is available if a portion of it is drawn down through the cusp-shaped opening 32.

The user's fingers F and thumb T may also apply a squeezing pressure to hold the scouring pad, if desired. The trailing location of the thumb-shielding hood 40 relative to the finger shielding hood 36 permits a heavy downward thrust by the fingers at a comfortable, natural angle.

Length of the invention 10 is preferably such that a palm portion P of a nominal-size human hand can press on the rounded rear 48 of the unit for stronger urging of the pad 46 when scouring heavy work. This co-acts with the rounded front end which promotes maneuverability and similarly coacts with the oppositely swept back respective profiles of the first hood 36 and the second hood 40, which, in effect, are part of first and second jaws.

Thermoplastic material such as polystyrene and polypropylene being somewhat softer than abrasives such as steel wool tends to yield at the surface under pressure and prevent slippage of a steel wool pad or the like, even though the pad is saturated with soap, but the plastic itself will not scar surfaces being scoured, although providing greater unit pressure. Thickness of a preferred embodiment of the arms and associated portions of the invention may be ⅛ to 3/16 inch (3 to 5 mm).

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States letters patent is:

1. In a holder (10) for protecting parts of the thumb and fingers of a user of a scouring pad held between a respective finger shielding out-turned portion and a thumb shielding out-turned portion, of the holder, and means resiliently aligning and biasing the finger shielding out-turned portion and the thumb-shielding out-turned portion for holding a said scouring pad, the improvement comprising: the finger shielding out-turned portion being a rigid, first hood (36) extending rearwardly, having an open rear (38) and proportioned for substantially enclosing the respective terminal joints of the user's fingers; the thumb shielding out-turned portion being a rigid second hood (40) extending rearwardly, having an open rear (44) and proportioned for substantially enclosing the terminal joint of the user's thumb; said means resiliently aligning and biasing being planar and including: a first arm (22) extending rearwardly from a first side of the rigid first hood (36) and then returning forwardly, as an inward arm portion (30), to said rigid second hood (40), a second arm (24) extending rearwardly from a second side of the rigid first hood (36) in spaced relation with the first arm (22); said inward arm portion (30) substantially filling the space between and guiding on said first arm (22) and second arm (24) for pinching a said scouring pad upwardly against said first arm and second arm.

* * * * *